United States Patent [19]

Cushman

[11] Patent Number: 4,630,538

[45] Date of Patent: Dec. 23, 1986

[54] PORTABLE LABEL MAKER

[76] Inventor: Larry A. Cushman, 5151 Windham, Sterling Heights, Mich. 48078

[21] Appl. No.: 725,555

[22] Filed: Apr. 22, 1985

[51] Int. Cl.[4] ..... B30B 15/30

[52] U.S. Cl. ..... 101/45; 101/66

[58] Field of Search ..... 101/66, 45; 400/613

[56] References Cited

U.S. PATENT DOCUMENTS

| | | | |
|---|---|---|---|
| 2,512,200 | 6/1950 | Duncan | 400/613 X |
| 2,674,894 | 4/1954 | Adshead | 101/66 X |
| 3,931,761 | 1/1976 | Carrus et al. | 101/66 |
| 4,094,244 | 6/1978 | Edwards et al. | 101/66 |
| 4,501,224 | 2/1985 | Shibayama et al. | 101/66 X |

*Primary Examiner*—Edgar S. Burr

*Assistant Examiner*—John A. Weresh

*Attorney, Agent, or Firm*—Krass & Young

[57] ABSTRACT

A portable label maker adapted for in-field use by electricians and the like the apparatus is self contained and permits printing, in standard wire label format, of single wiring labels. The apparatus also allows the printing of multiple copies of a single label, and the printing of sequences of labels. The label to be printed or first member of a sequence, is entered through a keyboard to be displayed on a display and stored in a memory. Subsequent commands entered through the keyboard control the printing operation including the specifications of the last member of a sequence. The printer and display may be of the dot-matrix type.

13 Claims, 3 Drawing Figures

PORTABLE LABEL MAKER

FIELD OF THE INVENTION

This invention generally relates to an apparatus for making labels and more particularly to an apparatus for making labels intended to be wrapped around the circumference of electrical wiring.

BACKGROUND OF THE INVENTION

Electrical wires are often bundled in cables, either prefabricated or created at the work site. In some applications, cables are used to organize a group of wires carrying coordinated electrical signals from one point to another. In other applications, cables are created primarily for the convenience of handling. When dealing with cables or bundles, it is useful to identify the signals carried by specific wires or equipment being connected by such wires.

Electrical standards, such as the National Electrical Code, have long recognized color coding systems for this purpose. However, it is often expedient to label cables for their individual wires with symbology rather than relying on solely on color codes.

Such labels generally consist of a strip of tape approximately 1.5 inches in length and 0.25 inches in width with adhesive on one side and symbologies on the other. The symbology is reproduced six times on each piece of tape, each line of symbols being parallel to the shorter dimension of the tape. In use, such labeling tape is wrapped with its long dimension circumferentially around the insulation of the cable or wire being labeled. The result is a labeling of the cable or wire which may be easily read, regardless of how it is twisted.

Labeling systems are often used by electricians in the field. "Brady" tape, manufactured by the W. H. Brady Company of Milwaukee, Wisconsin is a typical example of such a labeling system. A Brady system consists of a series of more than 1,000 cards, each card carrying many copies of a given combination of numeric and alphabetic codes. The cards are constructed from a sturdy plastic, approximately 2 inches by 9 inches in dimensions, may be broken away at appropriate points to allow removal of a single piece of labeling tape. For example, a complete set will contain all numerical combinations from 0 to 999 and be able to carry 25 copies of each combination.

To make such a system useful to the electrician, it is essential that a full collection of these cards be carried in the field, and that it be kept in an appropriate order, so that the electrician can efficiently accomplish the wiring job. A full collection of Brady cards is cumbersome and frequently leads to inefficiencies when cards are misfiled or the entire collection is dropped. It is also inefficient for the electrician to be carrying a full set of labeling cards when at most a small fraction of the labels contained on these cards will be used in a given wiring job.

A convenient method for creating wiring labels on demand on the job site without the inefficiencies of carrying a full collection of labeling cards and refiling the cards into the collection is, therefore, highly desirable.

SUMMARY OF THE INVENTION

This invention provides an apparatus for producing labels for electrical wiring, consisting of several repetitions of a given combination of symbologies, such as letters and numbers. The labeling machine is compact and portable, obviating the carrying of extra, usually unused, premarked labels.

The labels are printed upon any of a variety of standard width rolled adhesive tapes. A printer mechanism, including a printer head, possibly a dot-matrix type, is microprocessor controlled, and can be controlled to create allow for a variety of type sizes, fonts, and even printed colors. The printer can be powered by rechargeable batteries, the display device consuming essentially negligible power and the printer device requiring power only during the print operation.

Even though its intended primary use is as an electrical wiring labeling device, a similar apparatus could also be useful to other field labeling applications, such as plumbing and hydraulics or other special labeling applications, such as medical, dental, and scientific labels of specimens.

DETAILED DESCRIPTION OF THE PREFERRED EMBODIMENT

Figure 1:
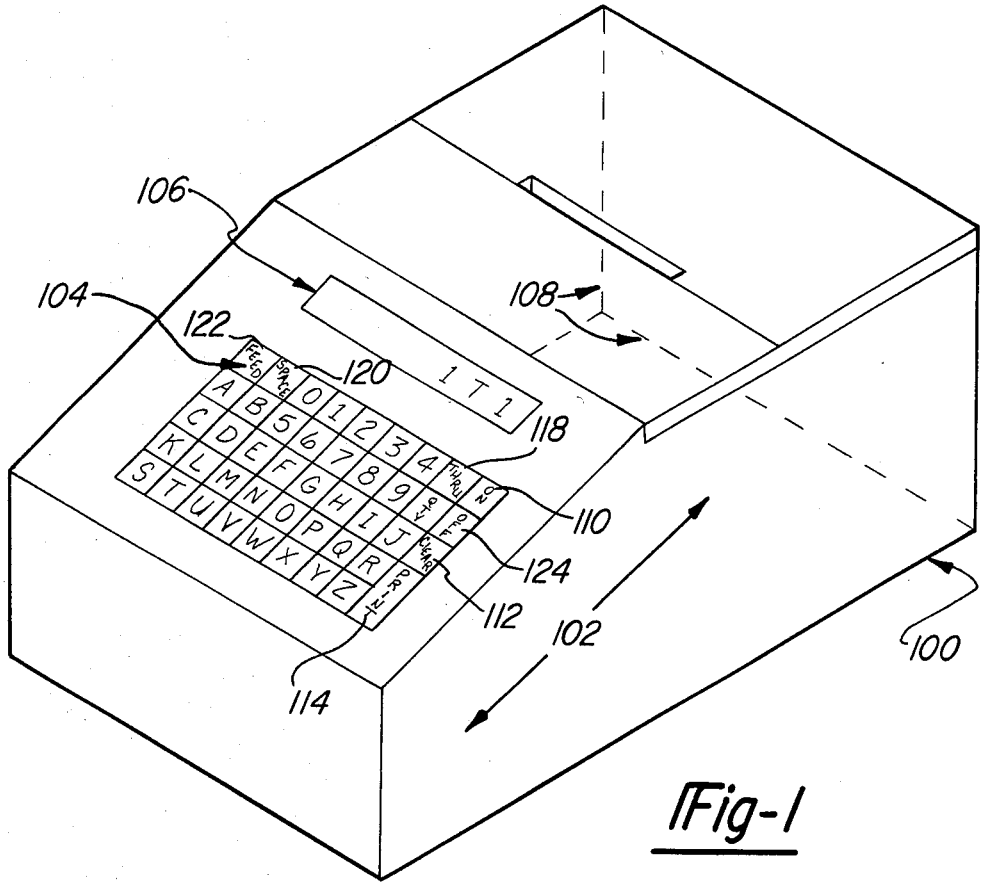
FIG. 1 is perspective drawing of a preferred embodiment of the labeling device.

Referring now to FIG. 1 of the drawings, which shows a perspective view of the preferred embodiment of this invention, a better appreciation for the invention may be gained. Label printer 100 consists of a body 102 containing a portable power supply (not shown), a keyboard 104 which may be of the membrane type, a display device 106, and a dot-matrix printer mechanism and tape dispenser container within body 102 and accessed through door or doors 108. The printer mechanism and the tape holder and dispenser will be described in greater detail at later point.

Keyboard 104 is used to first to turn on the device by pressing "ON" button 100. Next keyboard 104 is used to enter proper sequences of codes, for example, "1T1", which are also displayed on display device 106. In this example, an electrical wiring convention is used: "1T1" stands for load lead T1 on motor number 1. The user can vary the symbols shown in display 106, which may be of the dot matrix type, having the same number of horizontal and vertical dots as does the printer mechanism. "CLEAR" button 112, which clears display 106, may be useful in entering the desired sequence of symbols. Upon being satisfied that the proper sequence of symbols has been organized in the display device 106, the user may press "PRINT" button 114 on keyboard 104 to print the label corresponding to the symbols displayed on device 106. Alternatively, the user may press the "QTY" key 116, followed by a string of digits and "PRINT" key 114 to make the desired number of copies of the label composed on display device 106. As a second alternative, the user may use keyboard 104 to enter the printer mechanism into a "sequence" mode which, through entry of the proper sequence of inputs to keyboard 104, allows the user to create any sequence of labels starting with a first group and ending with a final group of symbols, including the printing of any desired number of copies of each label. After entering the first member of the sequence, say "101A," the user then presses THRU button 118, followed by the last member of the sequence, say "120A," followed by PRINT button 114. This initiates the uninterrupted printing of the sequence: "101A", "102A", . . . , "119A", "120A".

Other special symbol sequences, such as "SPARE", may be placed into display 106 with a single keystroke, such as on SPARE key 120. This will facilitate the printing of special labels such as "SPARE12." Also, the tape roll continued in body 102 may be advanced by pressing the FEED key 122.

When the user has completed a labeling task, the device may be turned off by pressing the "OFF" key 124.

Figure 2:
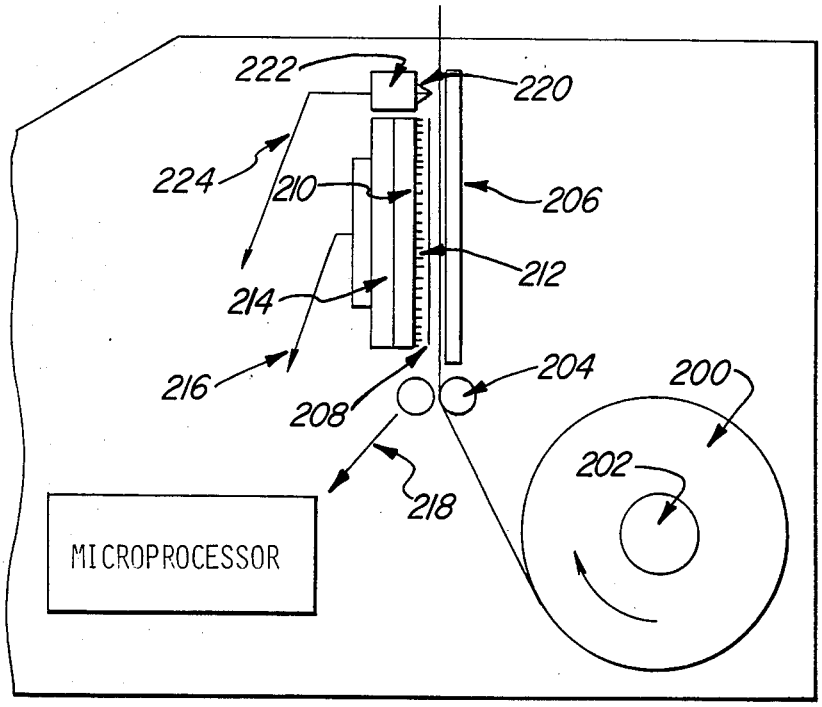
FIG. 2 is a schematic drawing showing a cross sectional view of the tape advance and printing mechanism of the preferred embodiment.

Referring now to FIG. 2 of the drawings, which shows a cross sectional view of the tape advance and printing mechanism of the preferred embodiment of the invention, one may see tape roll 200 which is rotatably attached to an axle 202. A leader of tape from roll 200 is passed between rollers 204 which pinch the tape and advance it forward through the mechanism, as the printer mechnism requires new tape to be fed. The tape is then led between platen 206 and ribbon 208. Outside of ribbon 208 is disposed dot-matrix print head 210 which may consist of a single or multiple rows of electromagnetically operated pins 212 attached to electromechanical or thermal printer head 214 which translates in the direction perpendicular to the plane of FIG. 2, printing the characters of the desired label code, one character per pass of print head 214. Under the control of signals to printer head 214 through cable 216, and to advance mechanism 204 through cable 218, both leading from the microcomputer control device to be described later, printer head 214 passes unidirectionally, printing as it moves. The characters in each label are printed, a column at a time, until the complete label is made up.

Upon completion of a label, positioning the scoring device 220 which is affixed to electromechanical operating means 222 via cable 224 to the microprocessor control device. The microprocessor then sends an appropriate cutting command to electromechanical device 222, thereby operating scoring device 220 scoring the tape at this point.

Figure 3:
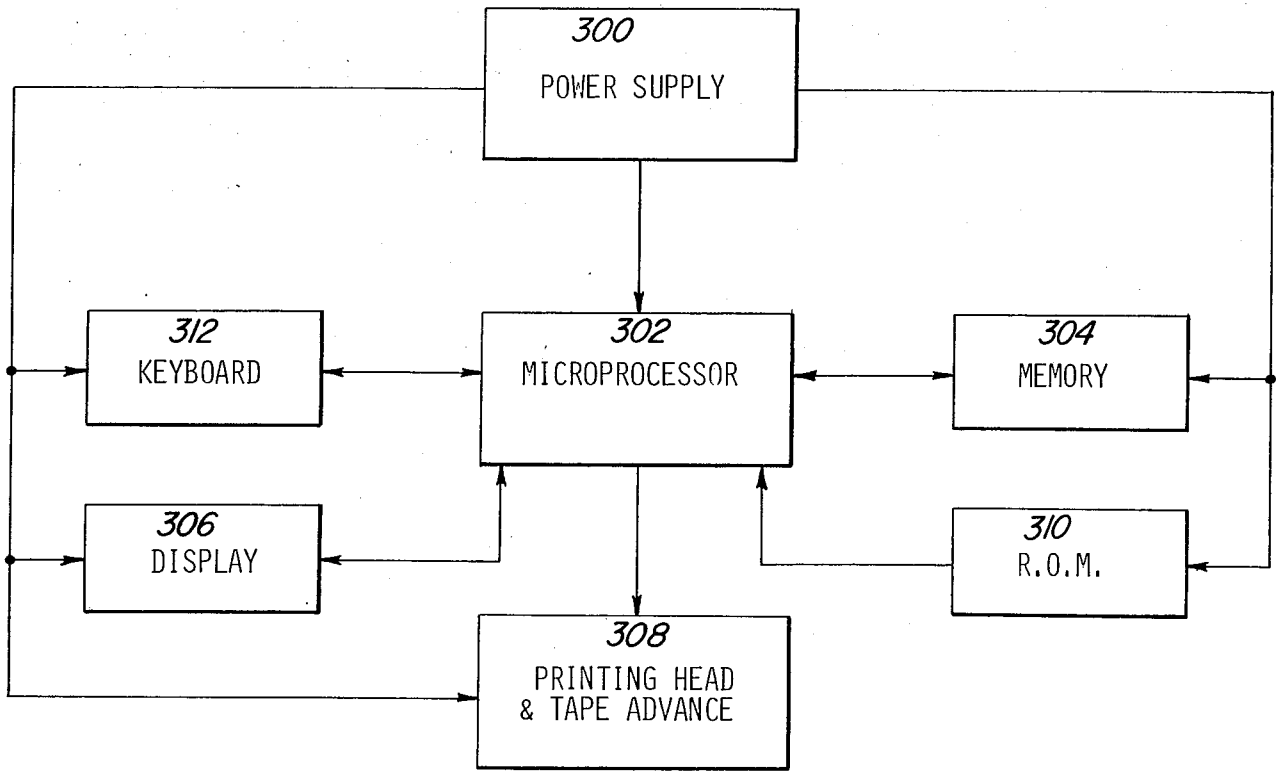
FIG. 3 is a schematic drawing showing the interactions required among various components of the labeling device.

Referring now to FIG. 3 of the drawings, an appreciation of the organization of the electronic structure of the preferred embodiment of the invention may be gained. Electrical power from power supply 300 which may consist alternatively of a rechargeable battery or household electric lines, is fed to various electronic components. These components include microprocessor 302, memory 304, display device 306 and printing mechanism/tape advance 308.

Upon turning on the device by pressing the ON key 110 (in FIG. 1) a control program is fed from read only memory 310 into microprocessor 302. Microprocessor 302 controls and coordinates data entries through keyboard 312 by means of continual inquiries directed to keyboard 312 to determine whether new keys have been pressed since the last inquiry. Using commands entered through keyboard 312, microprocessor 302 (1) causes the desired sequence of symbols to be shown on display device 306 and (2) stores this sequence in memory 304. Upon receipt of further inputs from keyboard 312, such as the number of copies of a given label to be produced, or the final member of a sequence of labels to be produced, which information is also stored in memory 304, microprocessor 302 supervises the retrieval of appropriate information from memory 304 and coordinates this information with signals sent to printing mechanism/tape advance 308, to cause the actual printing and cutting of the tape label.

Through the simple redesignation of the keys of keyboard 104 (in FIG. 1) and appropriate replacement of read-only memory 310 (in FIG. 3), and the possible replacement of the tape roll 200 to a more suitable type or size, the apparatus of this invention may be applied to a wide variety of applications. Examples are plumbing and hydraulics installation as well as medical, dental, and scientific labeling of specimens.

It is apparent that various alternative embodiments may be set forth by those skilled in the art without departing from the spirit or scope of the following claims, which are intended to encompass such alternative embodiments.

I claim:

1. Apparatus operable to make a plurality of copies of a designated sequence of symbology-bearing labels of adhesive tape, the tape being supplied in bulk, the bulk supply having a primary direction of orientation, the labels being defined by separation from the bulk by separating the tape along cut lines all having the same directional orientation to the primary direction of orientation of the bulk supply, the symbology borne by each of the labels being a copy of a member of the designated sequence and being contained within confines on the tape which are substantially parallel to the cut lines of the tape which define the labels, comprising:

means for causing the symbology to be placed on the tape within the confines;

means adapted to hold the bulk supply with its primary direction of orientation in fixed relationship to the symbology placing means;

input means for designating the number of copies and the sequence of symbologies desired to be borne by the labels;

means adapted to cause the symbology placing means to place the desired number of copies of the desired sequence of symbologies on the tape, the copies of the desired sequence being placed on the tape successively; and advancing means for urging the tape, after the symbology has been placed thereon, past the symbology placing means.

2. The apparatus of claim 1, including means for causing the tape to be scored along the cut lines.

3. The apparatus of claim 1, wherein the tape holding means is adapted to hold a plurality of the tape rolls in fixed relation to the printing means.

4. The apparatus of claim 1, wherein the printing means repetitively creates symbologies which align along lines which are perpendicular to the cut lines of the tape.

5. Apparatus operable to make a plurality of copies of a designated sequence of symbology-bearing labels of adhesive tape, the tape being supplied in rolls having a primary direction of orientation coincident with the axis of revolution of the roll, the labels being defined by separation from the bulk supply by separating the tape along cut lines all having the same directional orientation to the axis of revolution of the tape rolls, the symbology borne by each of the labels being a copy of a member of the designated sequence and being contained within confines on the tape which are substantially parallel to the cut lines of the tape which define the labels, comprising:

means for causing the symbology to be placed on the tape within the confines;

means adapted to hold the tape roll with its primary direction of orientation in fixed relationship to the symbology placing means;

input means for designating the number of copies and the sequence of symbologies desired to be borne by the labels;

means adapted to cause the symbology placing means to place the desired number of copies of the desired sequence of symbologies on the tape, the copies of the desired sequence being placed on the tape successively; and advancing means for urging the tape, after the symbology has been place thereon, past the symbology placing means.

6. The apparatus of claim 5, including means for causing the tape to be scored along the cut lines.

7. The apparatus of claim 5, wherein the printing means repetitively creates the symbology which align along lines which are perpendicular to the axis of the tape roll.

8. Apparatus operable to make a plurality of copies of a designated sequence of symbology-bearing labels of adhesive tape, the tape being supplied in rolls having a primary direction of orientation coincident with the axis of revolution of the rolls, the labels being defined by separation from the bulk supply by separating the tape along cut lines all having the same directional orientation to the axis of revolution of the tape rolls, the symbology borne by each of the labels being a copy of a member of the designated sequence and being contained within confines on the tape which are substantially parallel to the cut lines of the tape which define the labels, comprising:

printing means for causing the symbology to be printed on the tape within the confines;

means adapted to hold the tape roll with its primary direction of orientation in fixed relationship to the symbology placing means;

input means for designating the number of copies and the sequence of symbologies desired to be borne by the labels;

a microprocessor adapted to control the printing means to print the desired number of copies of the desired sequence of symbologies on the tape, the copies of the desired sequence being placed on the tape successively;

advancing means for urging the tape, after the symbology has been placed thereon, past the printing means;

means for causing the tape to be scored along the cut lines; and electrical power supply means, adapted to supply the electrical power required by the apparatus.

9. The apparatus of claim 8, wherein the input means is a keyboard input device.

10. The apparatus of claim 8, wherein the microprocessor means comprises a microcomputer and memory means.

11. The apparatus of claim 10, wherein the memory means comprise a digital random access memory and a digital read-only memory.

12. The apparatus of claim 11, wherein the read-only memory contains a progam adapted to allow a user to interact with the microprocessor means through the input means.

13. An apparatus operable to make a plurality of copies of a sequence of labels on a roll of adhesive tape having an axis of revolution, each label bearing a member of a designated sequence of symbologies, the sequence consisting of one or more symbologies, comprising:

a keyboard input device for receiving a designation of the sequence of symbologies and a designation of the number of copies of the sequence;

a display device for displaying the designation entered through the keyboard input device;

a microprocessor, adapted to receive the designations entered through the keyboard input device and to generate data signals representing successive copies of the desired sequence, comprising a random access memory (RAM) for storing designations entered through the keyboard input device, a microcomputer for controlling the storage and retrieval of the designations stored in the RAM, and a read-only memory for storing a program used by the microcomputer to perform its control functions;

printing means responsive to control signals and data signals from the microprocessor for causing the symbology corresponding to the data signals to be repetitively printed on the tape roll in a direction parallel to the axis of revolution of the tape roll, the symbology being readable in a direction perpendicular to the axis of revolution of the tape roll;

means adapted to hold the tape roll with its axis of revolution in fixed geometric relationship to the printing means;

advancing means, responsive to control signals from the microprocessor, for urging the tape past the printing means;

means responsive to control signals from the microprocessor for causing the tape to be scored along cut lines parallel to the axis of revolution of the tape roll; and electrical power supply means operative to supply the electrical power required by the apparatus.

* * * * *